United States Patent [19]

Kelly et al.

[11] 4,436,231

[45] Mar. 13, 1984

[54] METHOD AND MACHINE FOR PRE-FORMING AND TURNING GLOVES

[75] Inventors: James C. Kelly; Charles H. Shurden, both of Starkville, Miss.

[73] Assignee: Starkville Tool & Die Company, Starkville, Miss.

[21] Appl. No.: 320,505

[22] Filed: Nov. 12, 1981

[51] Int. Cl.[3] ..... A41H 43/00

[52] U.S. Cl. ..... 223/40

[58] Field of Search ..... 223/39, 40

[56] References Cited

U.S. PATENT DOCUMENTS

| | | | |
|---|---|---|---|
| 748,463 | 12/1903 | Ayres | 223/40 |
| 1,348,077 | 7/1920 | Baum | 223/40 |
| 1,735,688 | 11/1929 | Lowry | 223/40 |
| 1,766,502 | 6/1930 | Baum | 223/40 |
| 2,510,341 | 6/1950 | Keller | 223/40 |
| 4,023,720 | 5/1977 | Filko et al. | 223/40 |

FOREIGN PATENT DOCUMENTS

| | | | |
|---|---|---|---|
| 146315 | 2/1981 | German Democratic Rep. | 223/39 |

*Primary Examiner*—Louis Rimrodt

*Attorney, Agent, or Firm*—Breneman, Kane & Georges

[57] ABSTRACT

A method and apparatus for turning and pre-forming gloves is provided wherein the 5 fingers of a glove are mounted on a plurality of spaced members having resilient ends adapted for individually receiving a plurality of correspondingly spaced rods and a packer mechanism for disposition between at least two of said spaced tubular members for stretching the fingers of the gloves around the resilient ends of said tubular members and thereafter inserting said rods in the resilient ends of the tubular members to tension all of the fingers into the tubular members and thereafter releasing the packing device from between the fingers and further forming the fingers of the glove into the tubular members to a predetermined depth at which time a shuck element is activated to turn the palm and cuff of the glove over the plurality of rods of the turning rod assembly. The apparatus employs a pivotal platform having the plurality of spaced tubular members disposed thereon and a shuck element slideably mounted with respect to the spaced tubular members with an optional rake-off device to remove gloves from the turning rod assembly. The novel glove turning method and apparatus allows for the full automatic rapid turning of leather, work and layered gloves of various weights by centering, stretching, and relieving pressure on the glove to prevent damage during the step of turning the palm and body of the glove.

45 Claims, 11 Drawing Figures

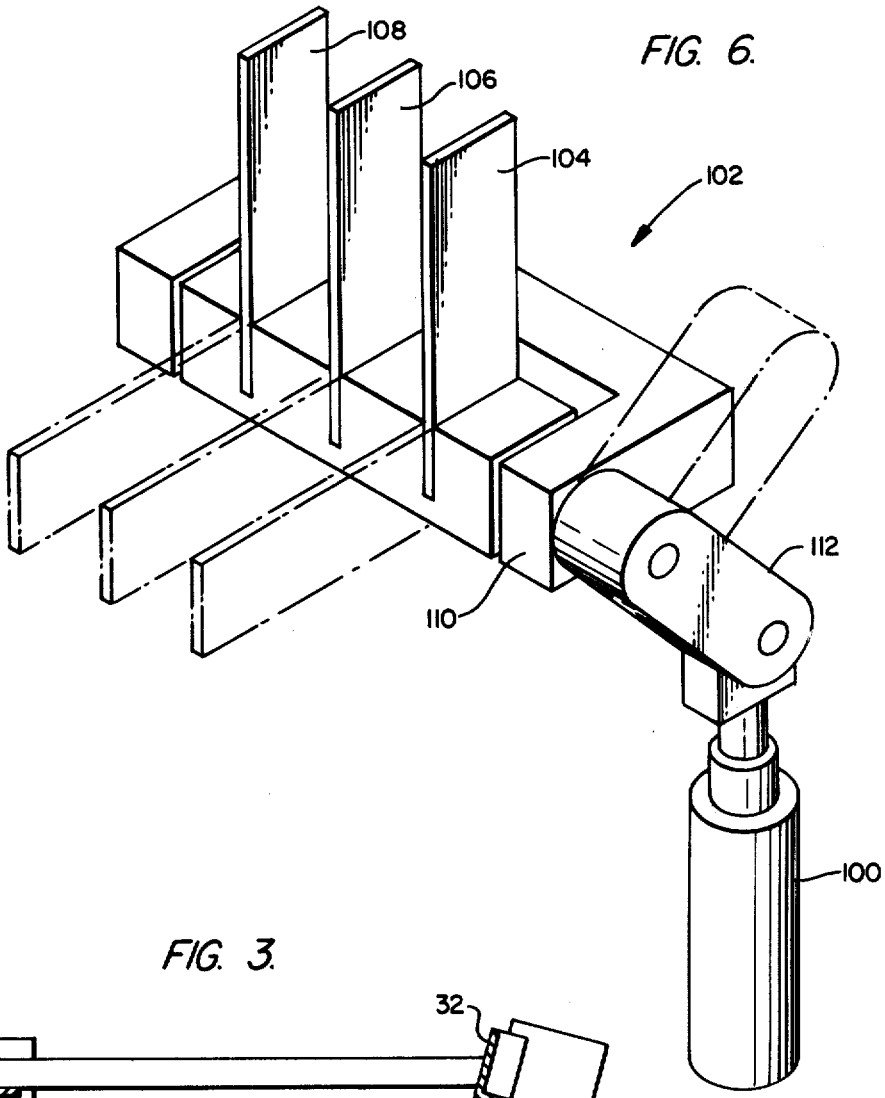
FIG. 6.
FIG. 3.
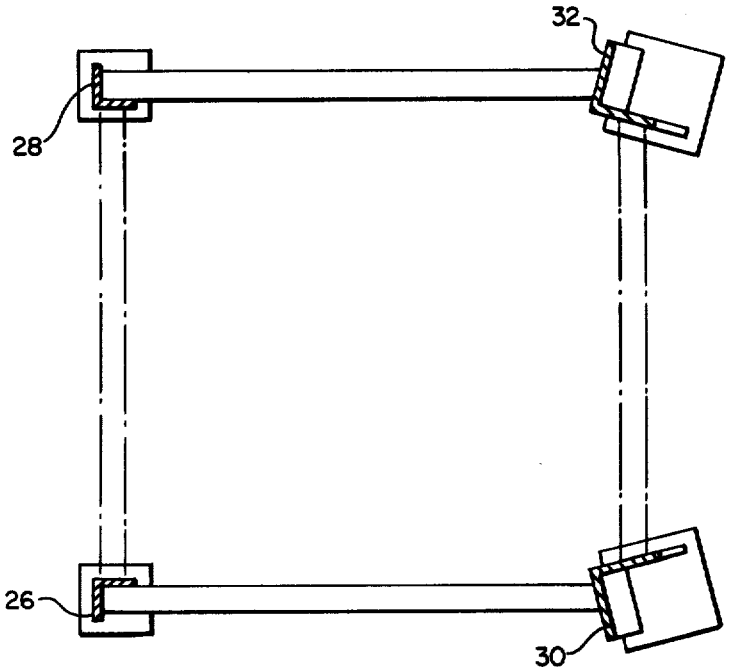

METHOD AND MACHINE FOR PRE-FORMING AND TURNING GLOVES

BACKGROUND OF THE INVENTION

1. Field of the Invention

The present invention pertains to a method and apparatus for turning and pre-forming gloves that utilizes a combination of spaced turning tubes having resilient floating ends disposed in the turning tubes which cooperate with a packing device for centering and pre-forming the glove by stretching the fingers of the glove around the resilient ends of the turning tubes which further cooperate with a plurality of turning rods which further pre-form and start to turn the fingers of the glove by inserting the turning rods into the floating ends of the turning tube to a predetermined depth which thereafter results in the release of the packing device and the further insertion of the fingers into the turning tubes and the subsequent activation of both the shuck assembly and at least one independently activated turning rod to release pressure on the glove while turning the glove over onto the turning rods and thereafter providing for the subsequent automatic release of the turned glove from the turning rods by a rake-off device. The invention provides a fully automatic device for pre-forming and turning lined and unlined work gloves and leather gloves by employing a packer mechanism for disposition between the fingers of the glove for centering and stretching the fingers of the glove before cooperating with the glove turning rods to further assist in the pre-forming and subsequent turning operation of the glove. The novel configuration and disposition of the packer device, resiliently mounted ends of the turning tubes and at least one individually activated turning rod from the turning rod assembly provides for the rapid turning of gloves of various weights.

2. Description of the Prior Art

The prior art includes a variety of glove turning mechanisms and devices that illustrate a number of mechanical devices for turning gloves. The application and utility of such prior art devices is not only dependent upon the speed which such devices turn gloves but also the quality of the final product. Some of the prior art devices have not had a widespread application in the industry because of the number of defectively turned gloves resulting from the ripping or tearing of the glove in the turning operation, poor quality of turned gloves, the cost of the machinery, the slow speed at which the machinery operates and problems of misalignment or improper operation of the article turning device. In addition, some of the available prior art glove turning devices particularly adapted to heavy gloves in the 32 Oz. weight do not turn the entire glove but instead turn only four of the fingers of the glove at which time the glove is removed from the machine which then requires the operator to place the thumb on one of the turning tubes to turn the thumb of the glove. A review of the prior art devices illustrates the problems encountered in the industry in attempting to provide a fully automatic and a reliable glove turning machine that can rapidly turn the entire glove in one operation and that can accommodate lined and unlined gloves of varying weights or thicknesses.

In Summers U.S. Pat. No. 2,427,933 an article turner is disclosed having four finger turning tubes with resiliently mounted inserts for mating with four turning rods. As can be readily recognized, U.S. Pat. No. 2,427,933 does not turn the entire glove in a single operation but instead turns the four fingers of the glove and thereafter requires the operator to unload the glove and load the unturned thumb in a subsequent thumb turning and manual glove body and cuff turning operation. Similarly, Filko et al U.S. Pat. Nos. 4,023,720 and 4,036,415 turns and blocks leather gloves in a two step and semi-automatic operation. Prior art such as U.S. Pat. Nos. 2,427,933; 4,023,720 and 4,036,415 do not turn the entire glove and do not provide a packing device for stretching and pre-forming the fingers of the glove around the turning tube ends nor do these inventions teach or describe the utilization of at least one individually activated turning rod to provide a complete turning of all the fingers of the glove along the body and cuff of the glove.

In Brownstein U.S. Pat. Nos. 2,286,057; 2,286,058 and 2,286,059 a glove turning and pressing machine is disclosed wherein all five fingers of the glove are turned by utilizing five turning tubes and rods that correspond to the five fingers of the glove. These patents utilize a prior art turning tube and turning rod combination that is not comparable to the present invention since this prior art does not utilize resilient ends of the turning tubes in combination with a packer mechanism to perform the pre-forming and turning of lined and heavy gloves such as are accommodated by the present invention.

The utilization of turning devices such as in the aforesaid patents do not provide the advantages of pre-forming of lined gloves and heavy leather gloves in accordance with the present invention since the combination of packer element and resilient ends in the turning tube are not utilized to provide the requisite pressure to force the stitches of the glove to grin in the pre-forming of the glove and prevent the destruction of the glove by the punching of holes in the glove as occurs when leather gloves and gloves of thicker layers are turned. In such machinery, thick gloves can be damaged because of the inability of such machines to relieve pressure in the glove during the time when the body and palm of the glove are turned. The disadvantages of machines such as disclosed in the patents is recognized in Wittler U.S. Pat. No. 3,143,258 in the description of such prior art including Beasley U.S. Pat. No. 2,838,216 which illustrates the problems encountered in turning heavy gloves which require the use of heavy plungers to turn heavy gloves but which plungers result in damage to heavy gloves caused by the punching of holes in the fingers and thumb by the turning rods in the glove turning process. In U.S. Pat. No. 3,143,258 a vacuum mechanism is utilized to assist in the glove turning process.

More recent developments in the prior art as represented by Horton U.S. Pat. No. 3,738,547 provide for the turning of gloves of various thicknesses including leather gloves without damaging the fingers of the glove. In U.S. Pat. No. 3,738,547 a semi automatic glove turning machine is provided having glove turning tubes with retractable plungers that are utilized to turn the entire glove. This prior art turns the glove in a series of steps that does not utilize a packing device to assist in the stretching and pre-forming operation of the glove. Instead a hacker 60 is employed to center the glove while the thumb of the glove is turned to get "the bulkiness of this portion out of the way" as pressure is placed on the cuff of the glove. The hacker is removed from the fingers and then the glove is subsequently turned in eight series of operational procedures. The present invention in marked contrast provides a single continuous operation for the centering, pre-forming and simultaneous turning of the fingers, thumb and body of the glove by utilizing a packer which cooperates with the turning rods and turning tubes to center and pre-form all the fingers and thumb of the glove in a continuous operation in which the shuck element subsequently cooperates with at least one independently activated turning rod to thereafter relieve pressure and simultaneously turn the body of the glove without damaging the glove.

The novel method and apparatus of the present invention for turning gloves of varying thickness including leather gloves and lined gloves along with the novel elements and cooperation of elements allows gloves of varying thicknesses to be rapidly turned without damage to the glove. The novel cooperation and disposition of the elements of the present invention along with the method of relieving pressure in the glove during the glove turning operation prevents damages to the fingers of the glove and allows the proper pressure to be independently maintained and exerted at various points and at varying times in the glove turning operation. The novel glove turning machine of the present invention furthermore assists in the pre-forming of the gloves by providing not only a centering but also inducing the proper grin on the finger tip threads to assist in subsequent glove forming operation.

The advantages of the present invention over the prior art includes the utilization of a packer element which cooperates with turning tubes having resilient ends in combination with the turning rod to assist in the centering and stretching of the threads to provide a grin in the thread and thereafter removing pressure in the thumb simultaneous with the turning of the body of the glove to prevent damage of a glove as it is being turned. The distinctions between the present method and apparatus and the cooperation of the components in providing the advantages of the present invention will become further apparent upon a comparison of the elements and methods of the prior art in conjunction with the drawings and specification of the present invention.

SUMMARY OF THE INVENTION

The disadvantages and limitations of prior art glove turning apparatus and methods including the problems encountered such as damaging, uneven turning, and slow turning of gloves has been remedied by the apparatus and method of the present invention which provides for rapid turning of gloves of various thicknesses including lined gloves by employing a novel combination and cooperation of mechanical components and method which not only increase the speed of the glove turning process but also provides pre-forming gloves by properly centering and stretching threads in the finger tip region of the glove to assist in the later forming of the glove. The present invention achieves its advantages over the prior art by utilizing an apparatus for turning the entire glove in a single operation by first stretching the fingertip threads of the unturned glove over turning tubes having resilient inserts by means of a packing mechanism which stretches and centers the tips of the unturned gloves over the turning tubes. Once the fingers of the glove are stretched to assist in the centering and grinning of the threads of the unturned glove a series of turning rods are utilized to cooperate with the packer mechanism and the resilient ends of the turning tubes to further stretch the threads in the fingers to obtain the desired grin or stretching of the threads and thereafter result in the release of the packer mechanism to complete the turning of the thumb and fingers of the glove. Once the fingers and thumb have been turned, a shuck element is activated simultaneously with at least one independently activated turning rod to result in the complete turning of the fingers and thumb of the glove.

The simultaneous turning of all of the fingers and thumb of the glove and the turning of the body of the glove could result in the tearing or ripping of the glove unless pressure is relieved prior to the turning of the body of the glove. In accordance with the apparatus and method of the present invention at least one of the finger turning rods, and in the preferred embodiment the thumb turning rod, is retracted at preferably the same rate of speed as a shuck mechanism travels upward to turn the body of the glove on to the turning rods. The travel of the shuck mechanism then continues until the body and cuff of the glove are turned over the turning rods for the subsequent removal of the turned glove from the glove turning rods.

The present invention is the result of an extensive research investigation into the utilization of pneumatically controlled machinery to rapidly and accurately turn lined and unlined gloves of heavy weight without damaging the glove while at the same time providing for a highly reproducible and reliable method and an apparatus for increasing the speed and ease of turning leather gloves, work gloves, and gloves with synthetic coverings while assisting in the overall quality of gloves by making the turned glove more comfortable to the wearer by providing a pre-forming operation.

Major drawbacks exist in the application of prior art equipment and methods to the turning of thick gloves and lined gloves, particularly gloves with synthetic materials, because such gloves resist alignment upon known prior art machinery resulting in high rates of defective gloves and production of turned gloves that were not of the uniform quality. In addition, the known prior art machinery is expensive to produce and operate and many times is incapable of providing gloves of a uniform quality and a comfortable fit because in the glove turning operation the stitches of the glove were not properly pre-formed.

In accordance with the present invention, it has been discovered the turning of the glove and the pre-forming of the glove in the turning operation is important in subsequent forming operations of the glove. As a result, if the glove is not properly centered in the glove turning operation, it will not have a comfortable fit even if the glove is not damaged in the subsequent glove turning operation. Research conducted was into a glove turning machine which would not only rapidly and reliably turn gloves but also provide a pre-forming of a glove to provide the proper centering and grinning of the threads in the fingertip region of the glove to assure that subsequent forming of the gloves is more effective and produces a more comfortable fitting glove.

In accordance with the present invention heavy gloves which are in the range of about 32 ounces such as terry cloth, quilted, or double lined gloves or leather gloves, driver gloves all leather and coated gloves having synthetic coverings are rapidly, and reliably turned with ease. Heavy gloves have heretofore been turned by first turning the four fingers and then taking the glove off the machine reloading the glove on the machine by placing the thumb on one of the turning tubes to thereafter turn the thumb and then manually turn the palm and cuff. In such turning operation the normal production of the plant is from about 30 cases of turned gloves per day per machine whereas the machine of the present invention is able to produce between 85 to 90 cases per day.

The increase in production of the present invention over the prior art including the quality of the glove turned is the result of an improved design which employs a pneumatically controlled machine to turn and pre-form a glove in about 2½ seconds. The design of the machine allows the operator to load one glove on the machine for example the right glove on the turning tube assembly and activate the machine. The machine thereafter automatically pre-forms turns and unloads the glove while the operator is loading the left glove onto the left side of the machine and then activating the left side of the machine. Typical production utilizing the apparatus and method of the present invention is about 12,000 gloves per day or about 400–500 dozen pairs of gloves a day.

In the preferred embodiment, the glove turning machine of the present invention has a right side for turning right hand gloves and a left side for turning left hand gloves to assist in the rapid turning of gloves. The left side of the machine utilizes the same switches and components except they are disposed to turn left hand gloves. In the preferred embodiment, the novel glove turning machine further includes a pivotally mounted platform having four spaced turning tubes having resiliently mounted ends which correspond to the four fingers of the human hand. A thumb turning tube having a resilient end is mounted in line with the index finger and in a spaced relationship.

A shuck element is slideably mounted in relationship to the turning tubes to assist in the turning of the body and cuff of the glove in a manner as will hereinafter be described in greater detail.

In an apparatus constructed in accordance with the preferred embodiment once the operator mounts an unturned glove over the turning tubes and shuck element a switch is activated which results in the pivoting of the platform in line with a packing element and an activation of the packing element to pivot the blades of the packing element to force the blades of the packer between the spaces between the turning tubes to center and stretch the unturned stitches around the ends of the resiliently mounted ends of the turning tubes and around of the base of the stitched fingers to provide a centering and stretching of the stitches at the tips of the fingers to force the finger tip threads to grin to pre-form the gloves and assist in the subsequent forming operation to make the glove more comfortable for the wearer.

The activation of the packer element results in the activation of a cylinder connected to four spaced turning rods which correspond to the four turning tubes on the glove turning platform. The fifth turning rod which corresponds to the turning tube for the thumb is independently activated by a cylinder in a manner that will be described hereinafter in greater detail.

The activation of the turning rods results in the turning rods being slideably disposed downward with respect to the turning tubes to contact the stretched finger tips of the glove so that the thumb and middle finger rods simultaneously contact the corresponding resilient ends of the turning tubes with the index and little finger tubes thereafter contacting the corresponding resilient ends before forcing the fingers into the turning tubes. The four finger turning rods are designed to contact indentations in the turning tube ends and once all the ends have been contacted begin to force the four fingers down into the turning tubes which then results in the activation of a switch to result in the release of the packer blades from between the turning tube rods. The turning tube rods are then further inserted into the turning tubes to a predetermined depth, which is adjustable depending upon the weight and thickness of the glove. At this point in the operation all the fingers and the thumb have been completely turned.

The completion of the turning of all the fingers and thumb of the glove results in the upward activation of the shuck and the upward activation of the independently activated turning rod at substantially the same rate of speed to not only result in the turning of the palm of the glove but also to relieve stress in the palm and thumb of the glove during the reversal of the thumb and palm in relation to the glove turning process. The thumb turning rod is independently retracted by a cylinder at preferably the same rate of speed as the cylinder activating the shuck assembly to turn the palm of the glove and cuff of the glove onto the turning rods. The completion of the travel of the shuck results in the activation of a further switch which returns the shuck to its rest position and pivots the platform containing the turning tubes and shuck assembly back to the loading position.

The turned glove that is disposed on the turning rods is then mechanically raked-off the turning rods with a rake-off assembly which due to the angular positioning of the turning rods results in the glove dropping into a glove tub or box disposed at the bottom of the machine. As is recognized the glove turning process results in the production of bulky gloves which should be compressed prior to further processing operations. In an emboidment of the invention a cylinder activated compress element is provided for compressing the gloves deposited in the glove tub. Typically, a plunger or paddle type compress mechanism is utilized to compress the gloves in the glove tub after a predetermined number of gloves have been deposited in the glove box. A standard air counter may be provided which after counting the deposit of 5 to 10 gloves in the glove tub results in the automatic activation of the plunger or paddle to compress the gloves to assist in subsequent glove forming and packing operations.

The features of the invention not only increase the rate of production of heavy gloves and gloves lined with synthetic materials but also provides a uniformally stretched and centered glove which makes the seams and stitches of the glove more comfortable to the wearer. These features of the process and apparatus of the present invention allows the adjustment of the machine to accommodate a variety of thickness and linings of gloves while at the same time increasing reliability and the rate of production of quality turned gloves.

DESCRIPTION OF THE DRAWINGS

Other advantages of the invention will become apparent to those skilled in the art from the following detailed description of the invention in conjunction with the accompanying drawings in which:

FIG. 3 is a top plan view of along the line 3—3 of FIG. 2 illustrating the angle of the upright prior to being turned 90° as described in FIG. 1;

FIG. 6 is a perspective view of the packer mechanism illustrating the two positions of the packer;

DETAILED DESCRIPTION OF THE INVENTION

Figure 1:
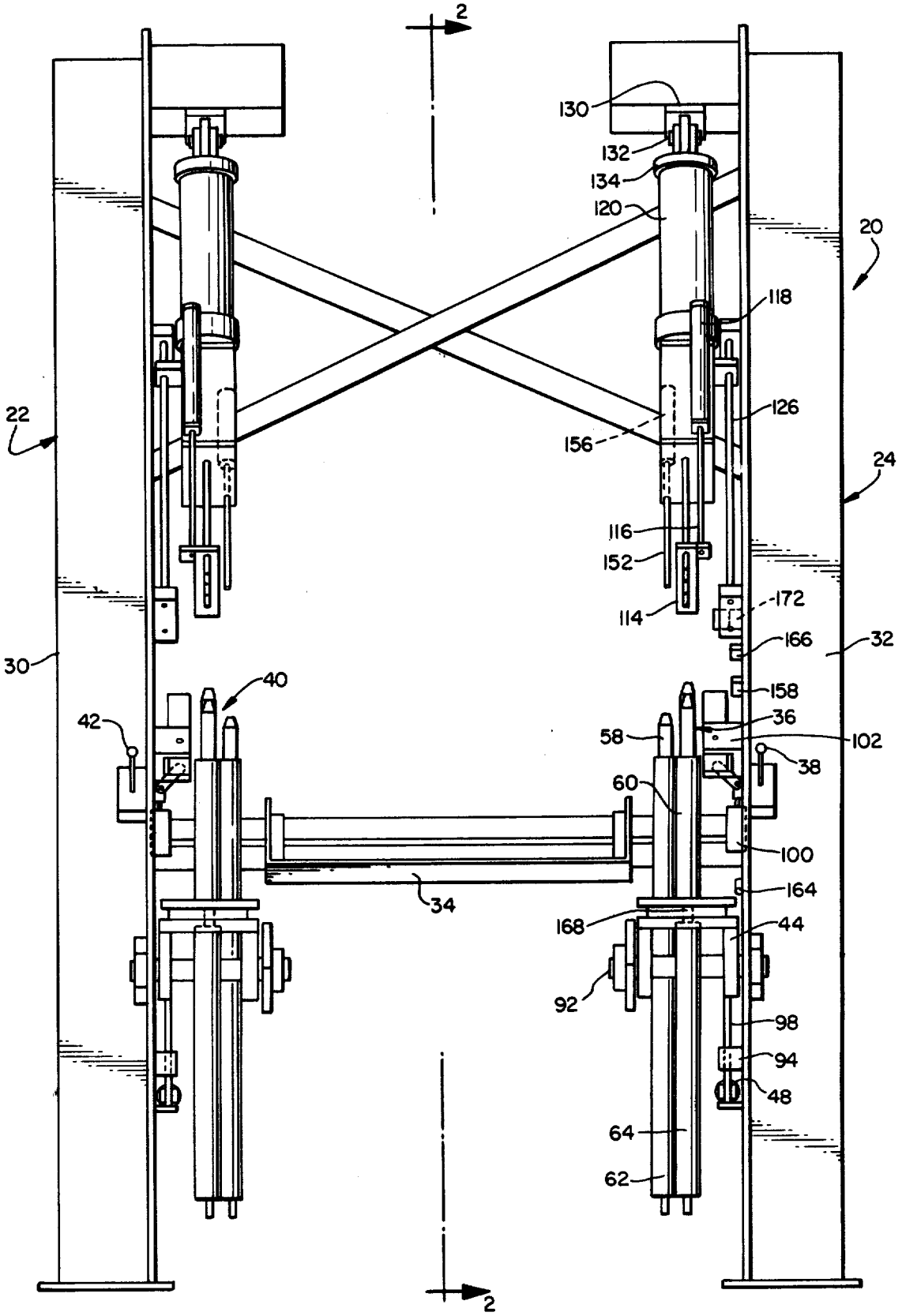
FIG. 1 is a front elevational view of the novel glove turning apparatus in which the upright supports have been turned outwardly slightly for purposes of illustration to provide a 90° frontal view.
Figure 2:
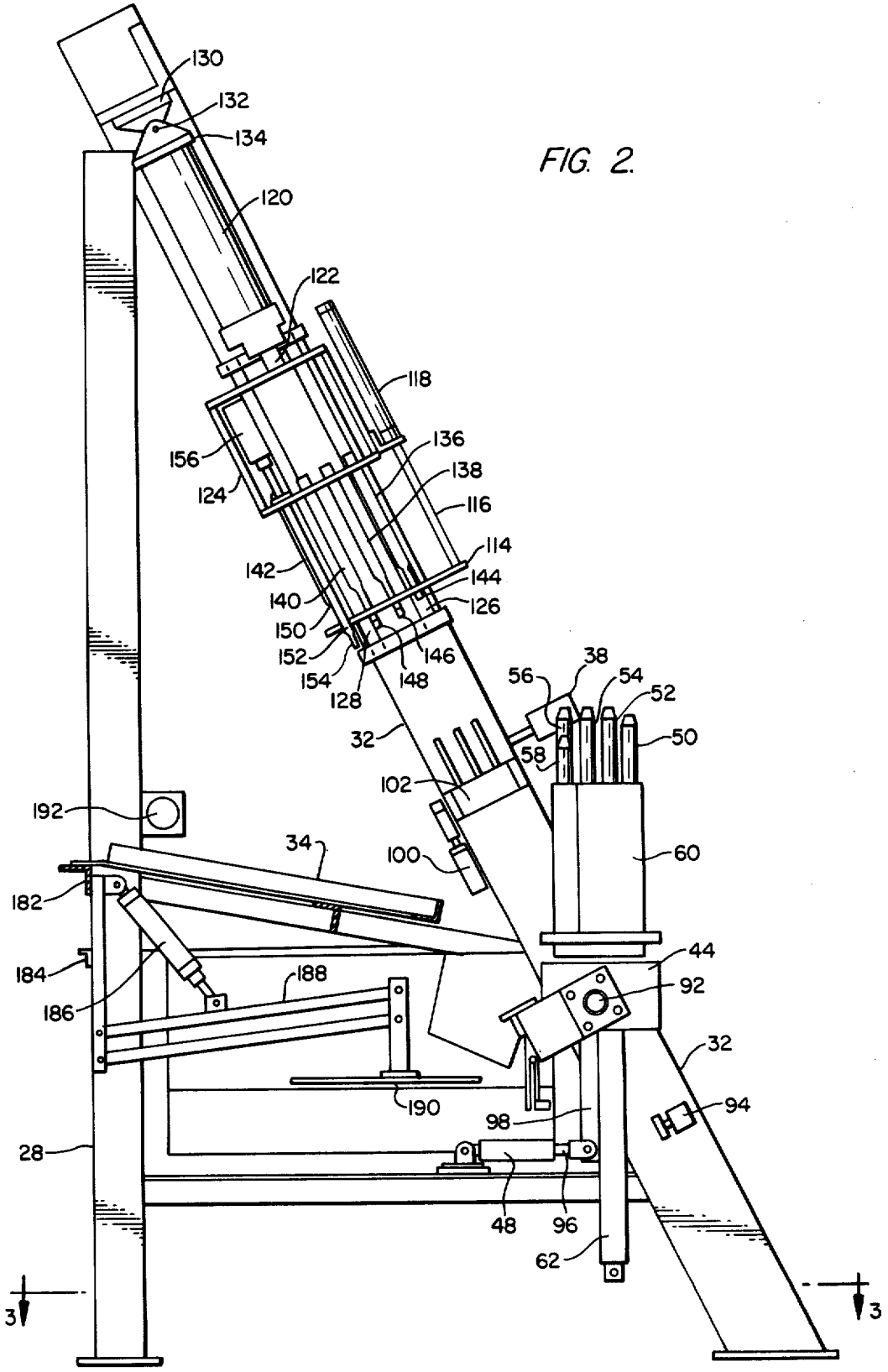
FIG. 2 is a side elevational view of FIG. 1 along the line 2—2.

Referring now to FIGS. 1-3, a novel glove turning machine 20 is illustrated having two sides 22 and 24 having the same elements disposed on each side except the elements on the right side are arranged for turning right hand gloves and the elements on the left side are designed to turn left hand gloves. The glove turning machine 20 is preferably formed by employing two upright supports 26 and 28, respectively (FIG. 2-3) to which angled support members 30 and 32 are angularly attached to provide support for the components of the novel glove turning machine. For purposes of detailing the arrangement of the components of the novel glove turning machine the angled support members have been turned slightly to provide a 90° frontal view. The pigeon-toed angle of the angled support members is illustrated in FIG. 3. A support frame 34 is provided to support a tub of unturned gloves to assist the operator in loading the gloves on the glove turning platforms. Additional elements such as protective shields and a funnel element for channelling turned gloves mechanically removed from the turning rods have been omitted to assist in the illustration and description of the components of the novel glove turning machine.

Sides 22 and 24 of the novel glove turning machine are identical in the disposition of the components and switches and in the operation of the machine except the glove turning tubes and glove turning rods on side 22 are arranged to turn the left hand whereas the glove turning tubes and rods on side 24 are arranged to turn gloves for the right hand. The novel machine is capable of turning heavy leather gloves, and lined and unlined gloves of various weights. The machine is designed to allow the operator to stand between supports 30 and 32 to alternatively load gloves on the right hand glove turning tubes 36 and activate switch 38 which thereafter automatically results in side 24 of the novel machine to pre-form, turn, and unload the glove as the operator loads a left handed glove on turning tubes 40 on the left side of the novel machine and activates switch 42 to result in side 22 automatically pre-forming, turning, and unloading the pre-formed turned left hand glove while the operator repeats the glove loading sequence for another glove on turning tubes 36 on side 24 of the novel turning machine. For ease of description of the components and method of turning gloves in accordance with the present invention side 24 of the machine will be described since side 22 of the machine provides the same function and same sequence in the glove turning operation.

Figure 4:
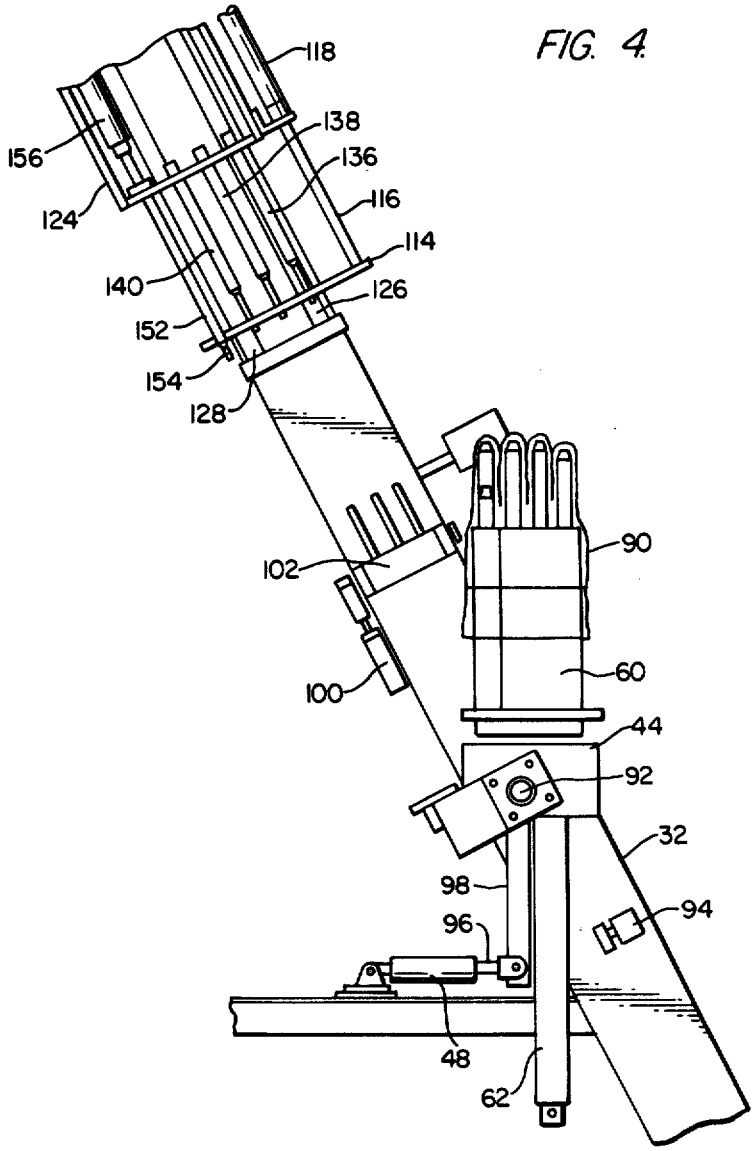
FIG. 4 is a side elevational view similar to FIG. 2 illustrating one side of the novel glove turning machine partly in section illustrating a glove mounted thereon.

In the preferred embodiment of the invention, the novel glove turning machine is pneumatically controlled and activated by a series of switches in a sequence as will be hereinafter described in greater detail. Referring now to FIGS. 1, 2 and 4 a pivotable platform 44 is provided to pivot from a substantially vertical position to a position in alignment with support 32 (FIG. 5) by the activation of cylinder 48. Pivotal platform 44 includes four spaced turning tubes 50, 52, 54, 56 in alignment that correspond to the four fingers of the hand. A thumb turning tube 58 is disposed adjacent to turning tube 56. A shuck element 60 is provided to surround the glove turning tubes 36 and is slideably activated with respect thereto by cylinders 62 and 64 in a manner as will be described hereinafter in greater detail.

Figure 7:
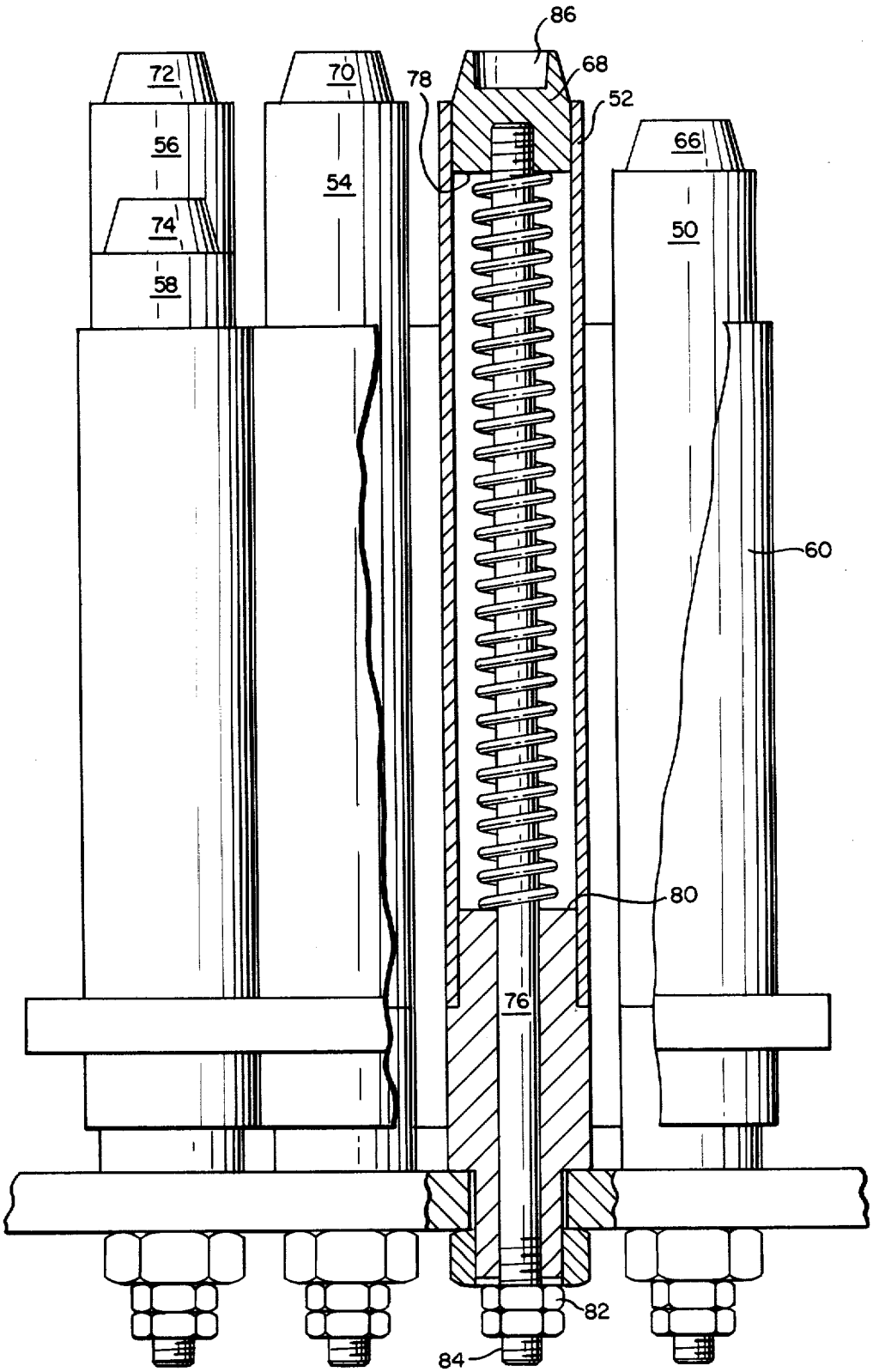
FIG. 7 is a side elevational view partly in section illustrating the disposition and component parts of the glove turning tubes.

In FIG. 7 the arrangement and disposition of the turning tubes 50, 52, 54, 56, and 58 is illustrated in greater detail wherein shuck element 60 is partially cut away. Turning tubes 50, 52, 54, 56, and 58 include resiliently mounted tips, inserts or ends 66, 68, 70, 72, and 74 respectively. The resiliently mounted ends are provided by mounting the ends to a spring and piston combination as is more particularly illustrated with respect to turning tube 52. End 68 like the other ends of the turning tube is mounted in turning tube 52 on a piston 76 having a spring bias provided against base 78 of end 68 and base 80 of turning tube 52 to allow the height of end 68 to be adjusted by the adjustment of a nut 82 disposed on a threaded end 84 of piston 76.

The individual adjustment of each of the turning tubes cooperates with the other elements of the novel glove turning machine to assist in the accommodation of a wide variety of glove materials and layered gloves. Each of the ends of the turning tubes further includes an indentation 86 which cooperates with the tapered ends of the turning tube rods as will be described hereinafter in greater detail. The inside and outside diameters of the turning tubes may be modified in size to accommodate various size fingers for gloves and weights of gloves to be turned. Typically, the outside diameter of turning tubes for turning gloves of 32 oz. weight in about 13/16th's of an inch in which the inside diameter may be designed to accommodate the weight of the glove being turned.

Figure 5:
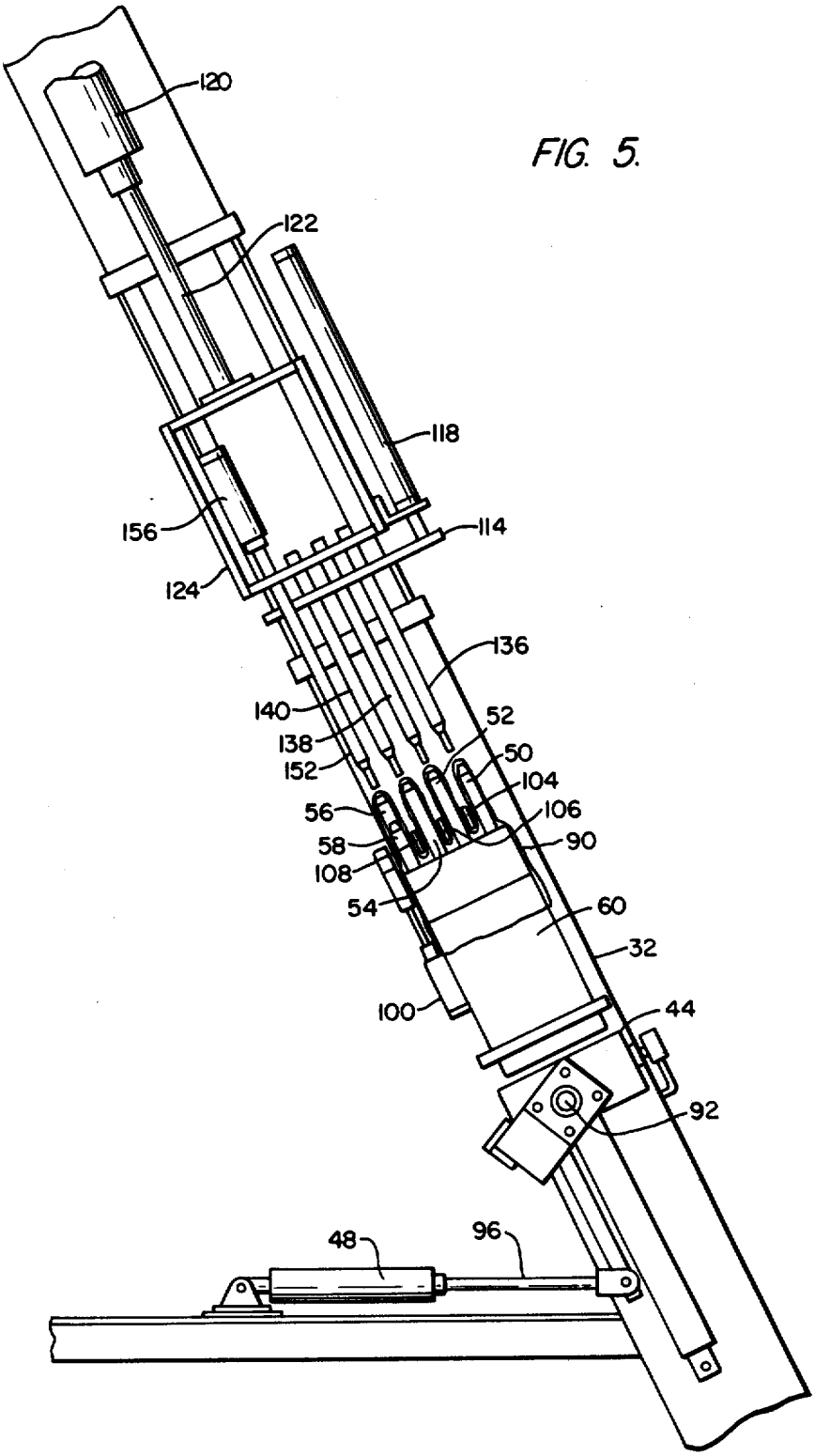
FIG. 5 is a side elevational view similar to FIG. 4 illustrating the operation of the packer mechanism.

The placement of an unturned glove 90 (FIG. 4) over the glove turning tubes 36 and shuck 60 and the activation of switch 38 results in the pivoting of platform 44 around pivot 92 by the activation of cylinder 48 to the position as illustrated in FIG. 5. The pivotal travel of platform 44 by the activation of cylinder 48 results in the automatic activation of the remaining switches including switch 94 (FIG. 4) by the extension of piston 96 forcing lever 98 to contact a contact of switch 94. The activation of switch 94 activates cylinder 100 to activate the packer device or element 102 disposed on support 32. The activation of cylinder 100 pivots the three packer blades 104, 106, and 108 which are pivotally mounted to a frame 110 utilizing a crank mechanism 112 as is illustrated in FIG. 6. The three packer blades in pivoting 90 degrees center the fingers of the unturned glove around turning tubes 50, 52 54 and 56 is illustrated in FIG. 5. The blades 104, 106, and 108 of the packer element center and pre-form the tips of the glove by pulling and stretching the fingertips of the glove around the resiliently mounted ends 66, 68, 70, 72 and 74 of the turning tubes.

The stretching of the finger tips of the glove around the spring loaded ends of the turning tubes as is illustrated in FIG. 5 results in the centering and preforming of the gloves by the cooperation between the blades of the packing device and the resilient ends of the turning tubes and the subsequent activation and cooperation of the turning tube rods. The activation of switch 94 also results in a retraction of glove rake-off bar 114 by the retraction of piston 116 in cylinder 118 and the activation of the turning rod cylinder 120 which advances piston 122 to advance the turning rod assembly 124 which is slideably attached to support 32 by two guide rods 126 and 128. Cylinder 120 is preferably attached to a support bracket 130 disposed on support 32 by a fastening pin 132 for attaching cylinder mounting bracket 134 to support bracket 130.

Turning rod assembly 124 includes four fixed turning rods 136, 138, 140 and 142 having tapered ends 144, 146, 148 and 150 respectively. The tapered ends of the turning rods are designed to assist in the centering and preforming of the glove by centering and fitting into indentations such as indentation 86 of turning tube 52 (FIG. 7) in the resilient ends of the turning tube assemblies.

Figure 8:
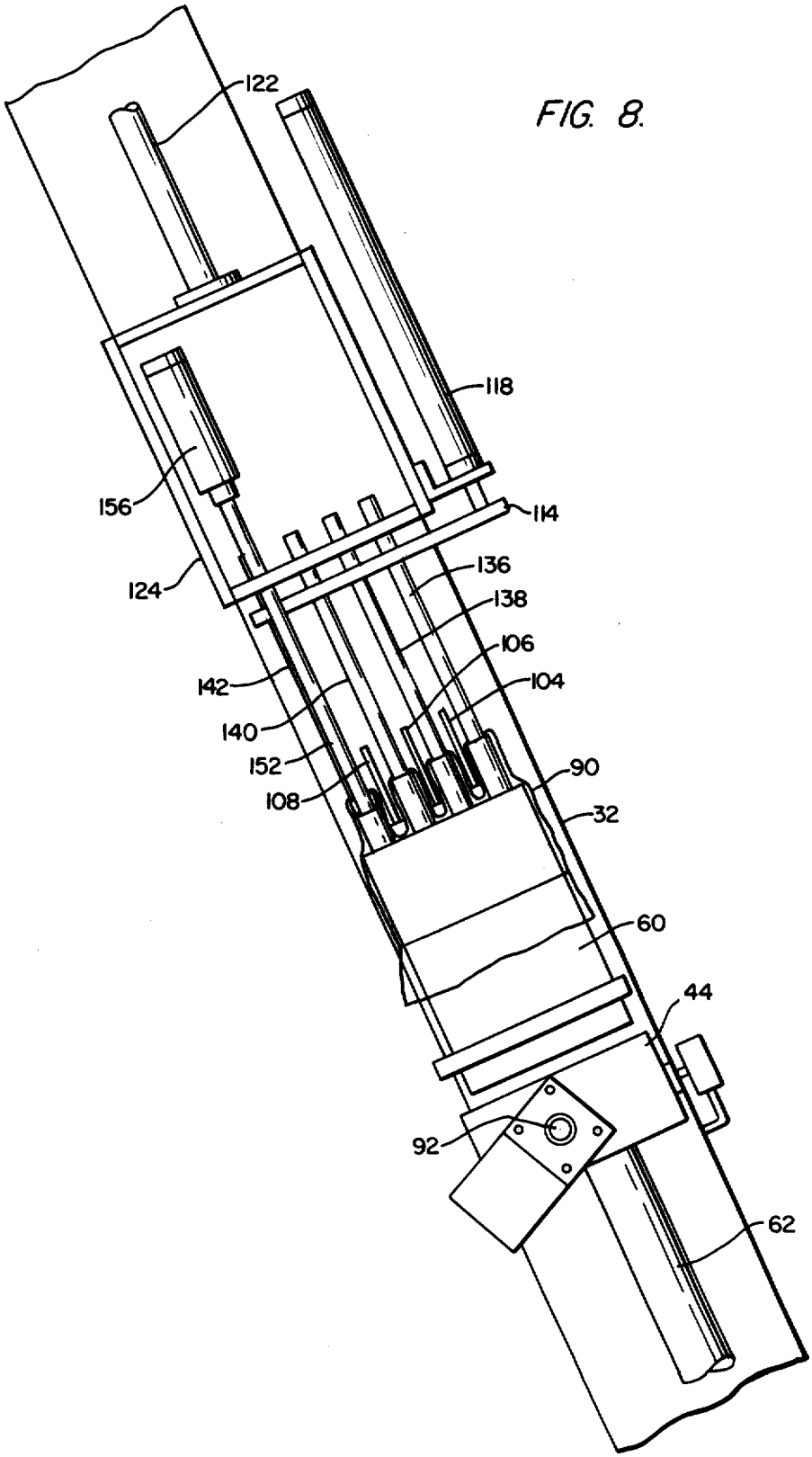
FIG. 8 is a side elevational view similar to FIG. 5 illustrating the cooperation of the packer, turning tubes and turning rods in turning the glove.

The activation of the turning rod assembly 124 also results in the activation of an independently activated thumb turning rod 152 having a tapered end 154 for engaging the indentation in end 74 of the thumb turning tube end 74. The independently activated thumb turning rod 152 is activated by a cylinder 156 at which point of contact the tapered ends 154, 146, and 148 contact ends 74, 70 and 68 of turning tubes 58, 52 and 54 and then tapered ends 144 and 150 contact ends 66 and 72 of turning tubes 50 and 56. At the point of contact the turning rods 136, 138, 140, and 142 and the thumb turning rod 152 are inserted and clamped into the spring loaded tips 66, 68, 70 and 74 of the turning tubes to center and pre-form the glove. Once the centering and desired stretching and preforming of the glove is accomplished a switch 158 is activated resulting in the retraction of the blades 104, 106, and 108 from between the turning tubes as is illustrated in FIG. 8. The continuous downward movement of turning rods 136, 138, 140, 142 and thumb rod 152 continues to a predetermined depth into the turning tubes 50, 52, 54, 56, and 58 with the tips of the glove fingers and thumbs still clamped into the indentations in the ends of resilient ends 66, 68, 70, 72, and 74 by the cooperation of the indentation such as indentation 86 of end 68 of turning tube 52 by the insertion of the tapered ends 144, 146, 148 and 150 and 154 of the turning rods.

Figure 9:
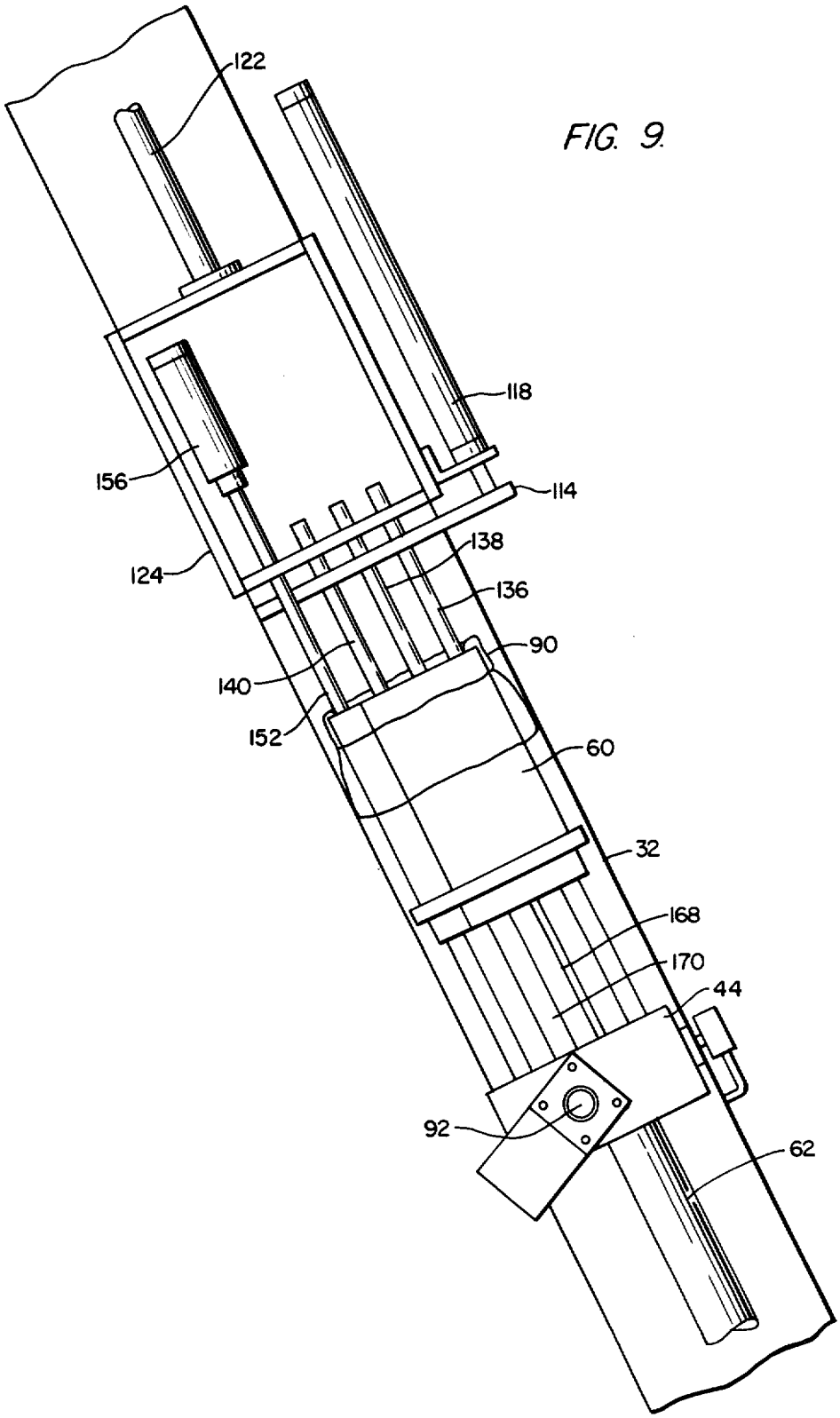
FIG. 9 is a side elevational view similar to FIG. 8 illustrating the operation of the shuck element and thumb turning rod of the novel glove turning machine.

Simultaneously with the activation of switch 158 to retract the glove packing mechanism cylinders 62 and 64 are activated to begin the upward travel of shuck element 60 to begin the turning of the palm and body of glove 90. The upward travel of shuck 60 continues to a predetermined point at which time a switch 164 is activated to begin the retraction of thumb turning rod 152 by the activation of cylinder 156. At the point of activation of switch 164 (FIG. 1) cylinder 156 retracts the thumb turning rod 152 at the same rate of speed as the shuck is travelling upwardly to relieve the pressure on the strained, stretched palm and thumb of the glove as it is being turned. It is important in accordance with the invention to relieve the pressure upon the thumb and palm of the glove during the glove turning operation. The continuous travel of shuck 60 and the retraction of thumb turning rod 152 continues until the glove is completely turned over the turning rods as illustrated in FIGS. 9 and 10.

Figure 10:
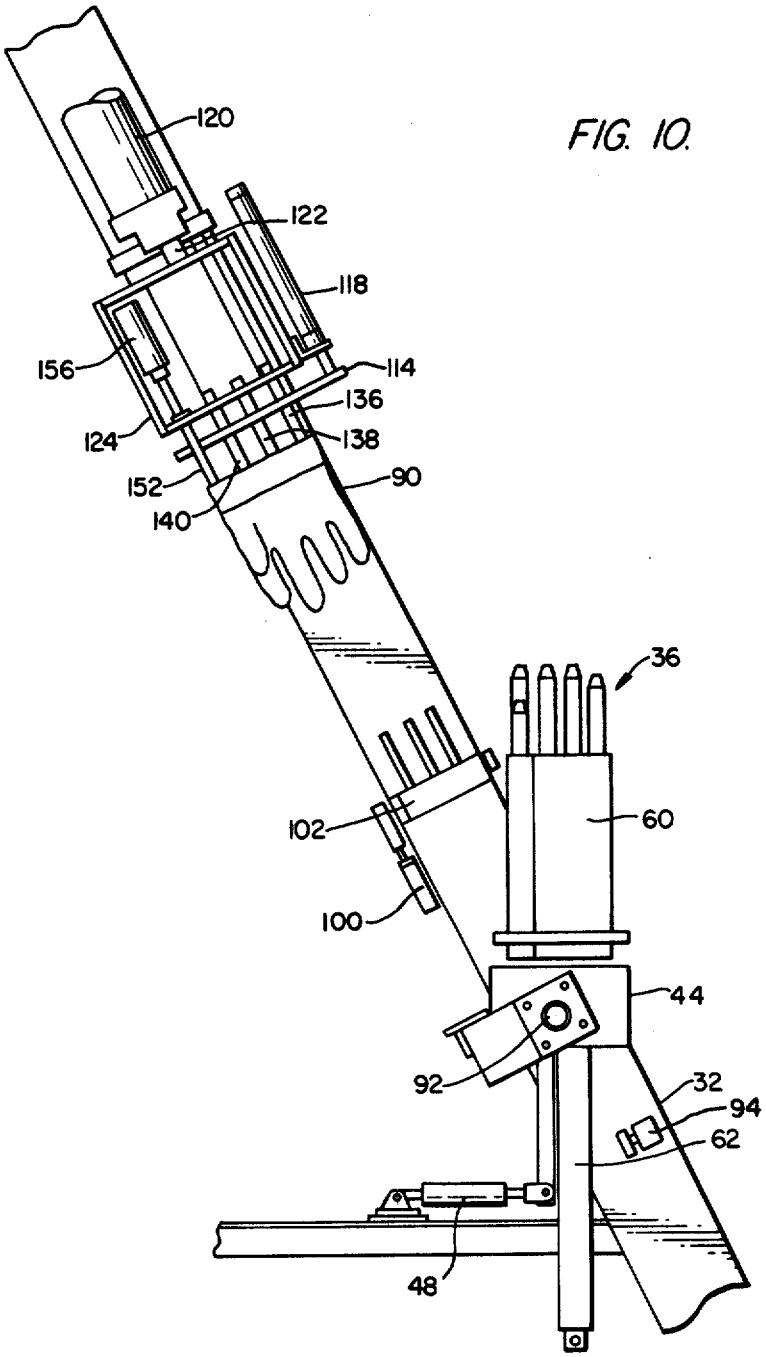
FIG. 10 is a side elevational view similar to FIG. 4 illustrating a turned glove disposed on the turning rods and the return of the glove loading platform.
Figure 11:
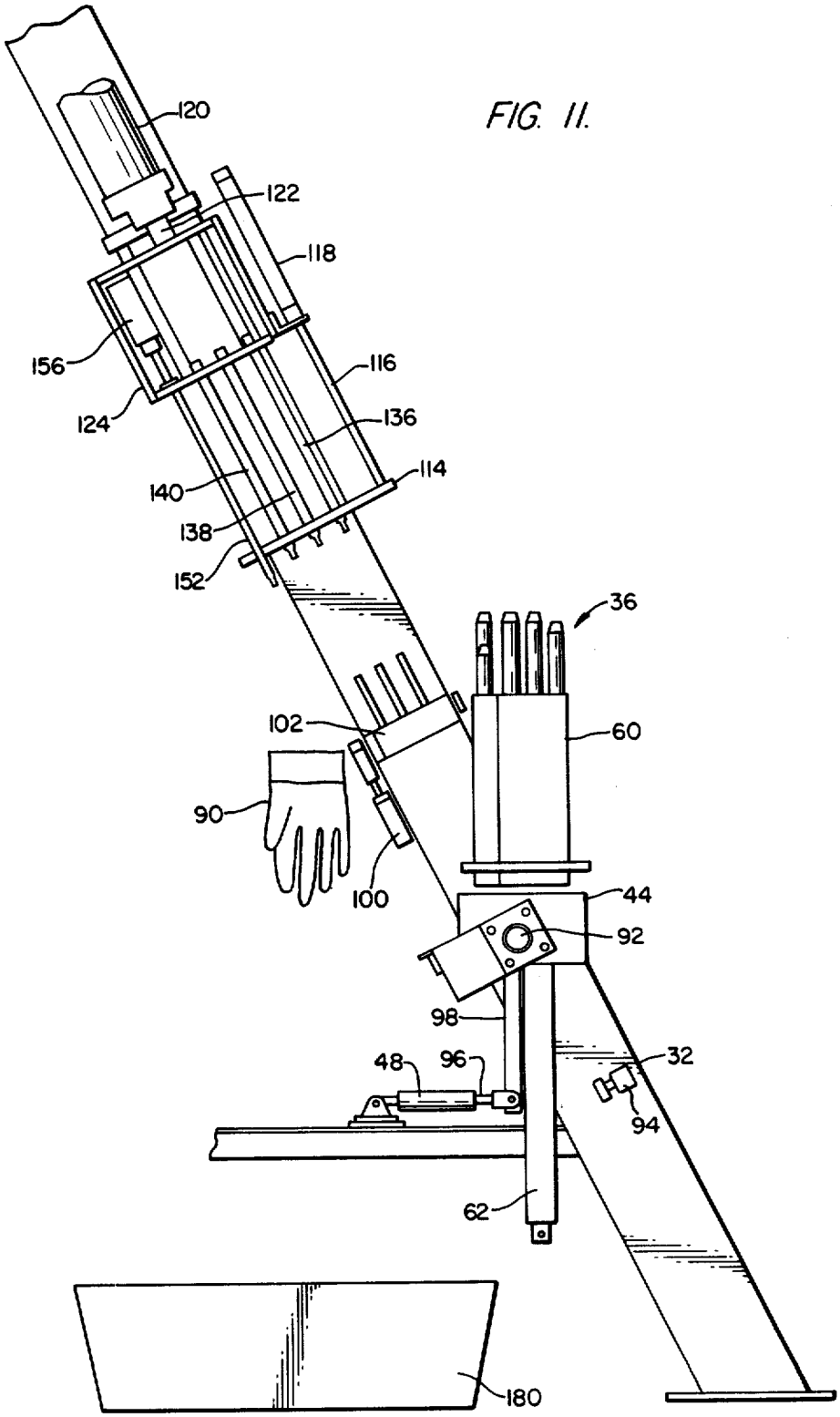
FIG. 11 is a side elevational view similar to FIG. 10 illustrating the operation of the glove rake-off element of the novel glove turning machine.

At the completion of the travel of shuck 60 glove 90 has been turned over on to turning rods 136, 138, 140, 142 and thumb turning rod 152 which then results in the activation of a switch 166 causing the retraction of air cylinders 62 and 64 which are connected by cylinder rods 168 and 170 to shuck 60 to subsequently return shuck 60 to its loading position on the turning tubes as is illustrated in FIG. 10. During the retraction of rods 168 and 170 in respective cylinders 62 and 64, cylinder 120 retracts piston 122 to raise turning rod assembly 124 with the turned glove on the turning rods as is illustrated in FIG. 10. On the retraction of the turning rod and thumb assembly 124 a switch 172 (FIG. 1) is activated which activates glove rake-off cylinder 118 which starts the downward travel of rake-off bar 114 to mechanically remove glove 90 from the glove turning rods. The design of the novel glove turning machine allows glove 90 to fall into a glove box 180 disposed underneath the glove turning machine (FIG. 11). The activation of switch 172 also results in the activation of cylinder 48 to return loading platform 44 to its upright position for reloading and turning the next glove as is illustrated in FIG. 11.

In a preferred embodiment of the present invention a paddle or plunger compressor is provided to assist in the stacking and packing of gloves in glove box 180 before further processing of the turned gloves. FIGS. 2, and 11 illustrate the disposition of the glove box 180 and the disposition of a plunger or paddle type compress disposed on the frame consisting of upright supports 26 and 28 and angled support members 30 and 32 and lateral supports 182 and 184 to which pneumatically activated cylinder 186 is disposed thereon for activation of a lever 188 having a flat compress 190 attached thereto. The activation of cylinder 186 and the resultant activation of compress 190 is provided for by utilizing a pneumatic air counter 192 disposed on support 28 which after a predetermined number of gloves have been deposited into tub 180 results in the activation of cylinder 186 to extend and pack the turned gloves into the glove box or tub 180.

The novel design of the present invention increases not only the speed at which gloves can be turned but also the uniformity and quality of turned gloves. Generally, the glove turning operation is one of the bottle necks in the production of gloves particularly in heavy leather gloves, work gloves, and gloves having synthetic layers and linings. The novel glove turning machine of the present invention not only turns the gloves by pre-forming them to stretch the stitches to provide a more comfortable wearing glove but also assures a more uniform quality of turned gloves by providing the proper centering and turning of the glove by utilizing the novel apparatus and method of the present invention.

The design of the novel glove turning machine allows the operator to rapidly load the right glove while the machine automatically pre-forms, turns, and unloads the left glove from the machine. The complete operation of centering, pre-forming, turning and unloading of the machine takes about 2½ seconds which gives the operator the time to load the next subsequent glove. The novel process of centering and grinning the threads in the tips of the fingers prior to turning the glove and the utilization of the independently actuated thumb for relieving pressure in the glove during the turning of the palm and body of the glove allows gloves of superior quality to be produced while reducing the damage and poor quality of gloves that are either torn or improperly formed on prior art machinery while dramatically increasing the speed at which gloves can be turned.

As will be recognized by those skilled in the art, the present invention has a wide range of applicability to various types of pneumatically activated and electrically activated machinery and may be utilized for articles other than gloves where the independent actuation of one of the members of the turning rod assembly is utilized to reduce strain and the possibility of ripping, tearing, and damage to articles that are turned in the industrial process. The invention consequently may be implemented in a variety of ways by those skilled in the art by utilizing the novel apparatus and techniques of the invention by obvious modifications and mechanical equivalents and the rearrangement of components to result in the advantages incumbent in utilizing the apparatus and method of the present invention.

It will be further appreciated that many changes in design and the disposition of the various components are possible and may be made by those skilled in the art for specific applications to achieve the results of the invention. Consequently, it is intended that these and other modifications and applications of the invention to a variety of systems are contemplated and may be made within the spirit and scope of the invention as defined in the following claims.

What is claimed is:

1. A method of pre-forming and turning gloves comprising:

(a) placing an unturned glove on five turning tubes having resiliently mounted ends;

(b) mechanically centering the fingers of said glove on said turning tubes by exerting pressure on the glove between said fingers;

(c) pre-forming the glove by stretching the stitches at the tips of the fingers of said glove by mechanically advancing five turning rods into the tops of said fingers and said resiliently mounted ends of said turning tubes while maintaining said pressure between the fingers of said glove wherein the thumb turning rod is mechanically actuated independently of the remaining turning rods;

(d) removing said pressure from between the fingers of said glove;

(e) mechanically removing pressure on said glove by removing said thumb turning rod at a rate of removal independent of the rate of removal of said remaining turning rods; and (f) mechanically turning in a single operation all the fingers, the thumb, the palm and wrist of said glove.

2. The method of pre-forming and turning gloves of claim 1 wherein said step of turning said fingers, thumb, and wrist is accomplished at the same rate of speed as said removal of pressure on said glove by removing said thumb turning rod.

3. The method of pre-forming and turning gloves of claim 2 further comprising the step of mechanically removing the turned glove from said turning rods.

4. The method of pre-forming and turning gloves of claim 3 further comprising the step of compressing said removed turned glove.

5. The method of pre-forming and turning gloves of claim 4 further comprising the step of counting a predetermined number of turned gloves before said step of compressing.

6. A method of turning and pre-forming articles comprising:

(a) placing an article on a plurality of spaced turning tubes having resilient inserts;

(b) pre-forming said article by mechanically exerting a first force on said article by pressing a plurality of rods on the article over the resilient inserts;

(c) mechanically turning all the parts of said article over said plurality of rods by applying a second force in a direction opposite from said first force to turn said article; and (d) mechanically removing at least a portion of said first force at a rate of speed independent of the rate of removal of the remaining portion of said first force to turn said article over said plurality of rods in a single mechanical operation.

7. The method of turning and pre-forming articles of claim 6 further comprising the step of centering said article on said turning tubes by first exerting a third force on said article in said spaces between said turning tubes.

8. The method of turning and pre-forming articles of claim 6 wherein the step of mechanically turning all the parts of said article comprises turning said article over said plurality of turning rods while removing said portion of said first force on said article by simultaneously removing at least one of said plurality of rods with the application of said second force.

9. The method of turning and pre-forming articles of claim 8 wherein said step of mechanically turning all the parts of said article and removing said portion of said second force on said article is accomplished in an opposite direction and at the same rate of speed as the application of said second force.

10. A method of turning and pre-forming articles of claim 8 further comprising the step of mechanically removing the turned article from said plurality of turning rods.

11. A machine for automatically turning gloves comprising:

(a) five turning tubes disposed in a spaced relationship to one another having ends resiliently mounted thereto;

(b) a shuck element disposed at the lower portion of said turning tubes and slideably mounted with respect thereto;

(c) a packer element for insertion in at least two spaces between said turning tubes; and (d) five turning rods for engaging said ends and cooperating with said packer element in the operative embodiment for stretching and centering the tips of said glove and turning an unturned glove disposed on said turning tubes.

12. The machine for automatically turning gloves of claim 11 wherein at least one of said five turning rods is activated independently of the other turning rods.

13. The machine for automatically turning gloves of claim 12 wherein said packer element has three blades for insertion between three spaces between said turning tubes.

14. The machine for automatically turning gloves of claim 12 wherein said turning tubes and said shuck element are mounted on a platform pivotally disposed to a frame.

15. The machine for automatically turning gloves of claim 14 wherein said packer element and said turning rods are mounted on said frame.

16. The machine for automatically turning gloves of claim 15 wherein said ends have indentations therein.

17. The machine for automatically turning gloves of claim 16 wherein the ends of said turning rods are tapered to fit into said indentations in said ends of said turning tubes.

18. The machine for automatically turning gloves of claim 12 wherein said independently activated turning rod is designed for operation in the same direction and at substantially the same speed as said shuck element.

19. The machine for automatically turning gloves of claim 18 further comprising a raker element slideably disposed with respect to said turning rods for removing turned gloves.

20. The machine for automatically turning gloves of claim 18 wherein said turning tubes and said shuck element are pivotally mounted to a first upright of a frame and wherein said packer element and said turning rods are mounted on said first upright.

21. The machine for automatically turning gloves of claim 18 further comprising:

(a) a second group of five turning tubes disposed in a spaced relationship to one another having ends resiliently mounted thereto;

(b) a second shuck element disposed at the lower portion of said second group of turning tubes and slideably mounted with respect thereto;

(c) a second packer element for insertion in at least two spaces between said second group of turning tubes; and (d) a second set of five turning rods for engaging said ends in said second group of five turning tubes and cooperating with said second packer element in the operative embodiment for stretching and centering the tips of said glove and turning an unturned glove disposed on said second group of five turning tubes.

22. The machine for automatically turning gloves of claim 21 wherein at least one of said second set of turning rods is activated independently of the other turning rods in said second group of five turning rods.

23. The machine for automatically turning gloves of claim 22 wherein said second group of five turning tubes and said second shuck element are pivotally mounted to a second upright of said frame and wherein said second packer element and said second set of five turning rods are mounted on said second upright.

24. The machine for automatically turning gloves of claim 23 further comprising an element for compressing turned gloves.

25. The machine for automatically turning gloves of claim 24 further comprising a counter for counting a predetermined number of turned gloves before activating said element for compressing said turned gloves.

26. The machine for automatically turning gloves of claim 23 wherein said machine is pneumatically operated.

27. An automatic machine for pre-forming and turning gloves comprising:

(a) a pivotable platform mounted to a frame having a substantially upright member;

(b) five turning tubes disposed in a spaced relationship on said pivotable platform said turning tubes having ends resiliently mounted thereto;

(c) a shuck element disposed at the lower portion of said turning tubes and slideably mounted with respect thereto;

(d) a packer element for disposition between at least three spaces between said turning tubes; and (e) five turning rods mounted on said substantially upright member for engaging said ends of said turning tubes and cooperating with said packer element for stretching and centering an unturned glove disposed on said turning tubes wherein one of said turning rods is activated independently of the other turning rods.

28. The automatic machine for pre-forming and turning gloves of claim 27 wherein said ends have indentations therein.

29. The automatic machine for pre-forming and turning gloves of claim 28 wherein the ends of said turning rods are tapered to fit in said indentations in said ends of said turning tubes.

30. The automatic machine for pre-forming and turning gloves of claim 29 wherein said one independently activated turning rod is designed for operation in the same direction and substantially the same speed as said shuck element.

31. The automatic machine for pre-forming and turning gloves of claim 29 further comprising a raker element slideably disposed with respect to said turning rods for removing turned gloves.

32. The automatic machine for pre-forming and turning gloves of claim 29 further comprising:

(a) a second pivotable platform mounted to said frame having a second substantially upright member;

(b) a second group of five turning tubes disposed in a spaced relationship on said second pivotable platform, said second five turning tubes having ends resiliently mounted thereto;

(c) a second shuck element disposed at the lower portion of said second group of turning tubes and slideably mounted with respect thereto;

(d) a second packer element for disposition between at least three spaces between said second group of five turning tubes; and (e) a second series of five turning rods mounted on said second substantially upright member for engaging said ends of said second group of five turning tubes and cooperating with said second packer element for stretching and centering an unturned glove disposed on said second group of five turning tubes wherein one of said second series of five turning rods is activated independently of the other turning rods.

33. The automatic machine for pre-forming and turning gloves of claim 32 wherein said first packer element is mounted on said first substantially upright member and said second packer element is mounted on said second substantially upright member.

34. The automatic machine for pre-forming and turning gloves of claim 32 further comprising a second racker element slideably disposed with respect to said second series of five turning rods for removing turned gloves.

35. The automatic machine for pre-forming and turning gloves of claim 34 further comprising an element for compressing turned gloves.

36. The automatic machine for pre-forming and turning gloves of claim 35 further comprising a counter for counting a predetermined number of turned gloves before activating said element for compressing said turned gloves.

37. The automatic machine for pre-forming and turning gloves of claim 32 wherein said machine is pneumatically activated.

38. A machine for forming and turning gloves comprising:

(a) a platform mounted to a frame having a substantially upright member;

(b) five turning tubes disposed in a spaced relationship on said platform said turning tubes having ends resiliently mounted thereto;

(c) a shuck element disposed at the lower portion of said turning tubes and slideably mounted with respect thereto;

(d) a plurality of turning rods mounted on said substantially upright member for engaging said ends of said turning tubes; and (e) at least one independently activated turning rod mounted with respect to said plurality of turning rods for cooperating with said shuck element and said plurality of turning rods for turning the fingers, thumb, palm and wrist of a glove in a single loading of said glove on said turning tubes.

39. The machine for forming and turning gloves of claim 38 wherein in said ends of said turning tubes have indentations therein and the ends of said turning rods are tapered to fit in said indentations.

40. The machine for forming and turning gloves of claim 39 wherein said at least one independently activated turning rod is designed for operation in the same direction and at substantially the same speed as said shuck element.

41. The machine for forming and turning gloves of claim 39 further comprising a raker element slideably disposed with respect to said turning rods for removing turned gloves.

42. The machine for forming and turning gloves of claim 38 further comprising:

(a) a second platform mounted to said frame having a second substantially upright member;

(b) a second group of five turning tubes disposed in a spaced relationship on said second platform, said second five turning tubes having ends resiliently mounted thereto;

(c) a second shuck element disposed at the lower portion of said second group of turning tubes and slideably mounted with respect thereto;

(d) a second plurality of turning rods mounted on said second substantially upright member for engaging said ends of said second group of five turning tubes; and (e) a second at least one independently activated turning rod mounted with respect to said second plurality of turning rods for cooperating with said second shuck element and said second plurality of turning rods for turning the fingers, thumb, palm and wrist of a glove in a single loading of said glove on said second group of said five turning tubes.

43. The machine for forming and turning gloves of claim 42 further comprising a second raker element slideably disposed with respect to said second plurality of turning rods for removing turned gloves.

44. The machine for forming and turning gloves of claim 43 further comprising an element for compressing turned gloves.

45. The machine for forming and turning gloves of claim 42 wherein said machine is pneumatically activated.

* * * * *